US005109783A

United States Patent [19]

Shimizu

[11] Patent Number: 5,109,783

[45] Date of Patent: May 5, 1992

[54] FULL ROTARY HOOK WITH AN INCREASED AMOUNT OF BOBBIN THREAD WOUND AROUND THE BOBBIN

[75] Inventor: Hiromitsu Shimizu, Osaka, Japan

[73] Assignee: Hirose Manufacturing Co., Ltd., Osaka, Japan

[21] Appl. No.: 665,232

[22] Filed: Mar. 6, 1991

[30] Foreign Application Priority Data

May 15, 1990 [JP] Japan ..... 2-126364
May 15, 1990 [JP] Japan ..... 2-126365
May 15, 1990 [JP] Japan ..... 2-126366

[51] Int. Cl.[5] ..... D05B 57/14
[52] U.S. Cl. ..... 112/231
[58] Field of Search ..... 112/228, 181, 231, 230, 112/184

[56] References Cited

U.S. PATENT DOCUMENTS 683,847 10/1901 Catenalli et al. ..... 112/230
2,949,874 8/1960 Kuhar ..... 112/231
2,974,618 3/1961 Kuhar ..... 112/231
3,199,480 8/1965 Covert et al. ..... 112/231
3,347,193 10/1967 Perri ..... 112/231 X
3,373,707 3/1968 Ketterer ..... 112/231 X
3,682,121 8/1972 Kasawaki ..... 112/231
4,884,250 12/1989 Simizu ..... 112/231

*Primary Examiner*—Werner H. Schroeder
*Assistant Examiner*—Paul C. Lewis
*Attorney, Agent, or Firm*—Wenderoth, Lind & Ponack

[57] ABSTRACT

The amount of a bobbin thread wound in a bobbin of a full rotary hook is increased by making a circumferential portion of a bobbin case holder between a thread separating portion and a thread releasing portion thinner than the remainder of the circumference, thereby increasing the inner diameter of the bobbin case holder. Thereby, the inner diameter of the bobbin housed in the bobbin case holder and the inner diameter of the cylindrical portion housing the bobbin case can be increased and consequently an outer diameter of a flange of the bobbin can be increased, thereby increasing the amount of the bobbin thread wound around the bobbin.

4 Claims, 11 Drawing Sheets

Fig. 9 (1)
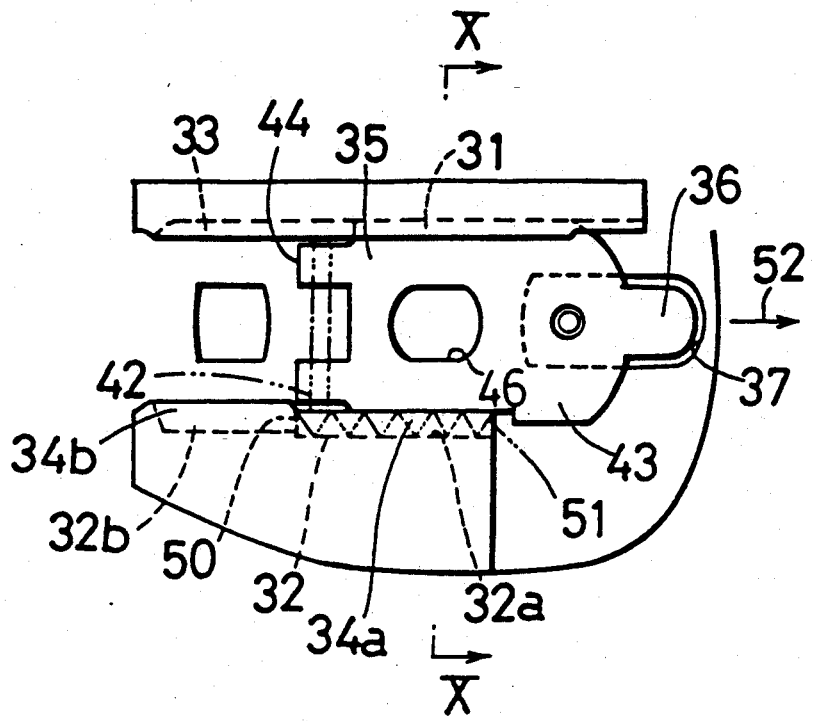
Fig. 9 (2)
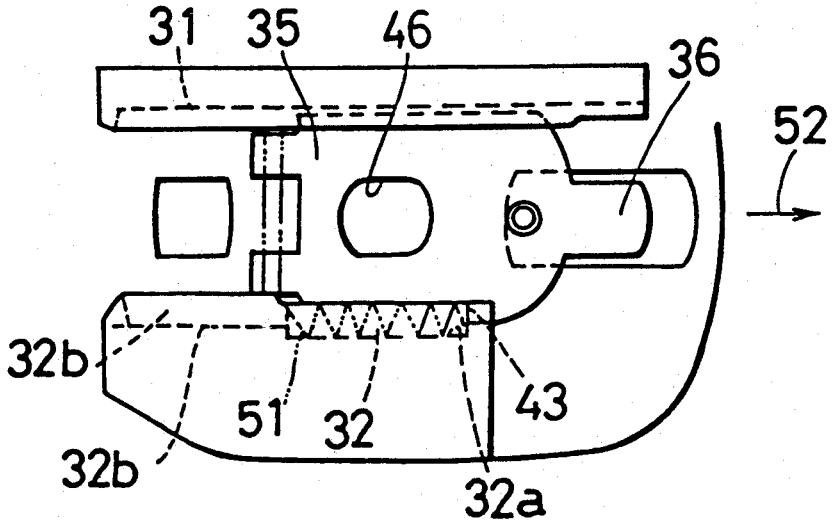

Fig.12 (1)
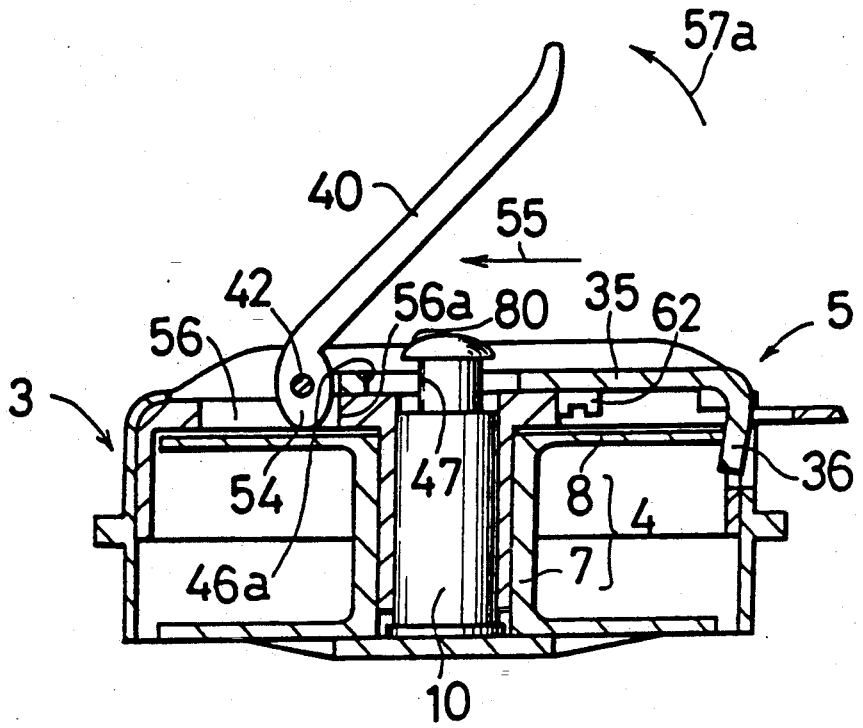
Fig.12 (2)
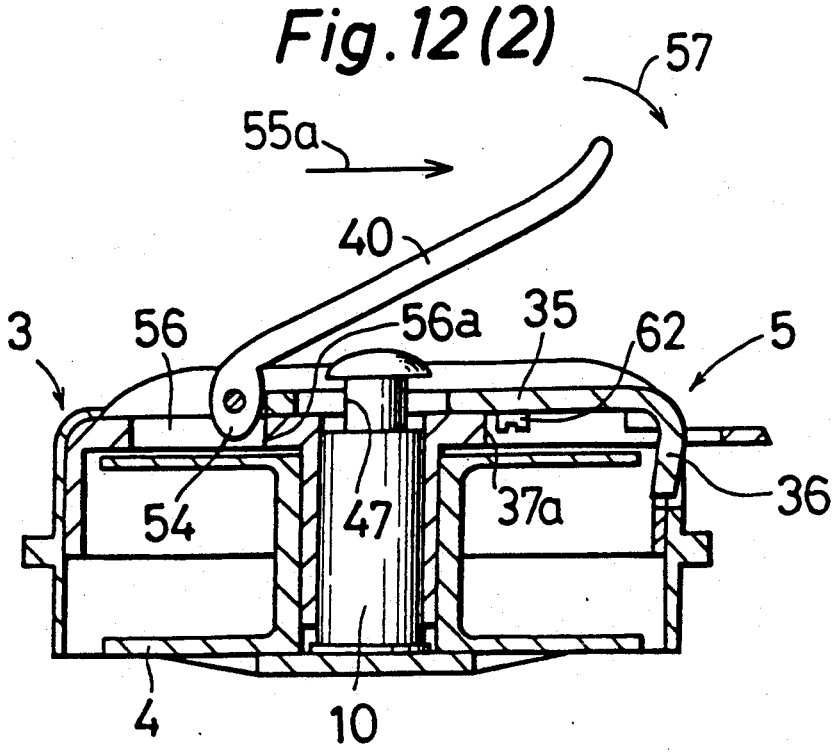

Fig. 12 (3)
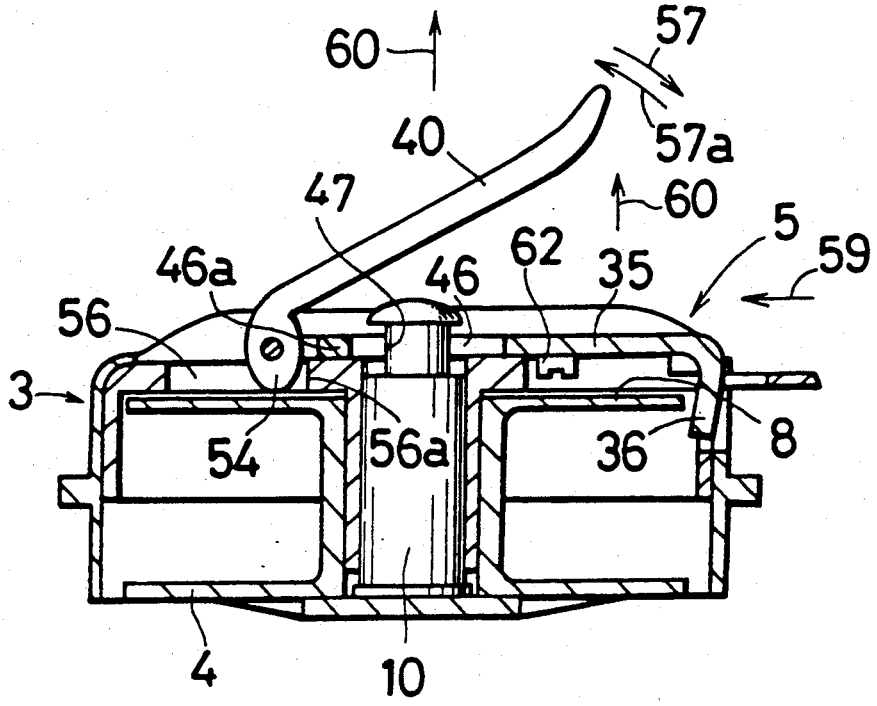
Fig. 12 (4)
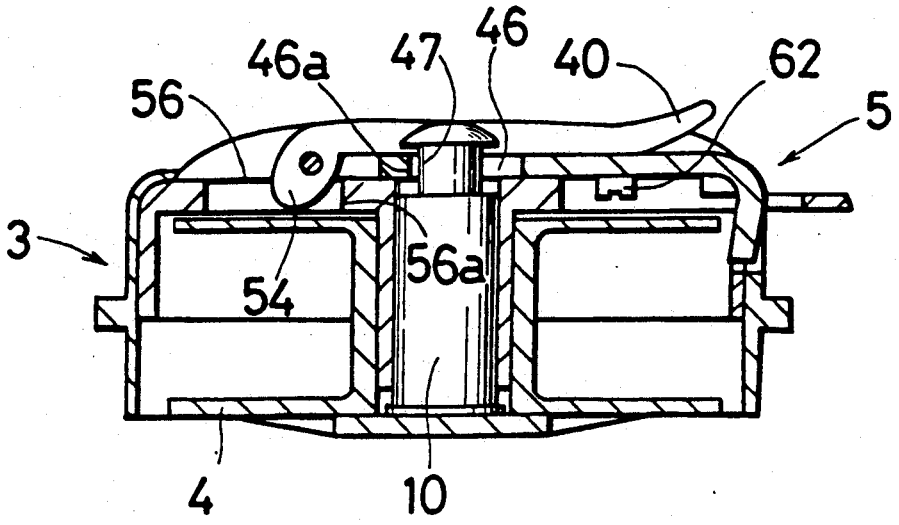

FULL ROTARY HOOK WITH AN INCREASED AMOUNT OF BOBBIN THREAD WOUND AROUND THE BOBBIN

BACKGROUND OF THE INVENTION

1. Field of the Invention

The present invention relates to a full rotary hook of a sewing machine.

2. Description of the Prior Art

It is necessary to increase the quantity of bobbin thread wound on a bobbin to improve productivity.

In a full rotary hook of a sewing machine, it is desired to provide a construction where the quantity of bobbin thread wound on a bobbin is increased as much as possible while the remainder of the structure, such as the structure for installing a bobbin case by latching it in a bobbin case holder, remains the same.

In the operation of a sewing machine, it is necessary that a looped needle thread smoothly through a contact portion between a rotation restraining notch of the bobbin case holder and a rotation restraining member which enters the notch and prevents the bobbin case holder from rotating together with the hook body, in order to improve sewing performance. This is desired also in the case of a full rotary hook where the quantity of bobbin thread wound on a bobbin is increased.

SUMMARY OF THE INVENTION

An object of the invention is to provide a full rotary hook which makes it possible to increase the quantity of bobbin thread wound on a bobbin.

Another object of the invention is to provide a full rotary hook which makes it possible to increase the quantity of bobbin thread wound on the bobbin and to simplify the operation of installing and latching a bobbin case in a bobbin case holder.

A further object of the invention is to provide a full rotary hook which makes it possible to increase the quantity of bobbin thread wound on the bobbin and to improve sewing performance by making it possible for a looped needle thread to pass smoothly between a bobbin case holder rotation restraining notch and a rotation restraining member which is fitted in the notch.

The invention provides a full rotary hook including a bobbin case holder having an increased inner diameter and a circumferential portion of the bobbin case holder between a thread separating portion and a thread releasing portion being thinner than a remaining circumferential portion.

The invention provides a full rotary hook including a bobbin case having an outer flange formed to guide a needle thread loop and control slackness thereof to a small amount and a latch member installed to be freely movable in a radial direction of the bobbin case by being guided at opposite sides along a pair of opposed guide grooves of the bobbin case. The latch member is latched into a stud of the bobbin case holder.

The invention also provides a full rotary hook wherein a cylindrical portion of the bobbin case holder and a cylindrical portion of the bobbin case partially overlap on each other in an axial direction. The cylindrical portion of the bobbin case is provided with an outward flange to guide a needle thread loop and control its slackness to a small amount.

The invention further provides a full rotary hook wherein an upstream end of the cylindrical portion of the bobbin case holder, relative to a hook body rotating direction, and a downstream end of the cylindrical portion of the bobbin case, in the hook body rotating direction, oppose each other near a rotation restraining notch of the bobbin case holder, and the end of the cylindrical portion of the bobbin case holder is located radially outwardly of the end of the cylindrical portion of the bobbin case.

According to the invention, the inner diameter of the cylindrical portion of the bobbin case holder which houses the bobbin case can be increased and thereby the outer diameter of a flange of the bobbin flange can be increased. Thereby, the quantity of bobbin thread wound on the bobbin can be increased.

When the inner diameter of the cylindrical portion of the bobbin case holder is increased while the size of the hook body remains the same, according to the invention needle thread will be between the outer periphery of the cylindrical portion of the bobbin case holder and the inner periphery of the hook body only at the circumferential portion between the thread hook portion and the thread releasing portion. Therefore, the thickness of this cylindrical portion can be decreased to prevent a large friction force from being generated between the outer periphery of the cylindrical portion of the bobbin case holder and the inner periphery of the hook body. The thickness of the remainder of the cylindrical portion of the bobbin case holder is increased to provide necessary strength, and needle thread is not present between the outer periphery of such remainder and the inner periphery of the hook body. Therefore, the necessary strength can be obtained by increasing the thickness of such remainder of the circumferential portion of the bobbin case holder.

Thus, the quantity of bobbin thread wound on a drum of the bobbin can be increased without decreasing the strength of the bobbin case holder.

According to the invention, the cylindrical portion of the bobbin case holder and the cylindrical portion of the bobbin case are made to overlap each other in the axial direction along a portion of the circumferences thereof. Thereby, it is possible to make the inner diameter of the bobbin housing space of the bobbin case coincide with the inner diameter of the cylindrical portion of the bobbin case holder, so that the inner diameter of the bobbin case and therefore the outer diameter of the bobbin flange can be increased. On the cylindrical portion of the bobbin case is formed an outer flange which guides the needle thread loop and controls slackness to a small amount, thus improving sewing performance.

Furthermore according to the invention, the bobbin case is installed in the bobbin case holder by latching, and opposite of the latch member are freely movable in the radial direction of the bobbin case and are guided along the pair of opposed guide grooves of the bobbin case, thereby enabling the latch member to latch an end of the stud of the bobbin case holder, thus preventing the bobbin case from escaping from the bobbin case holder.

When removing the bobbin case from the bobbin case holder, the latch member is moved from the latched state to an unlatched state. The latch member is provided at an end thereof with a bent tail portion passing through a hole formed in an outer flange of the bobbin case and entering the inside of the bobbin case. When the latch is moved so that latching is released, the tail portion holds a flange of the bobbin, and therefore the bobbin case and the bobbin can be removed together from the bobbin case holder.

The latch member has a spring receiving element which projects outwardly from one side thereof, and a spring is interposed between the spring receiving element and the bobbin case holder. The spring urges the latch member radially outwardly, i.e. in a direction to achieve latching.

According to the invention, when fitting the latch member with the tail portion projecting to the inside of the bobbin case so that the latch member is guided along the pair of guide grooves of the bobbin case, a part of one guide groove is recessed further from the opposite guide groove. That is, a part forming the first guide groove is partially broken away. Therefore, with the tail portion fitted, one side of the latch member including the spring receiving element is exposed from the first guide groove and the opposite side of the latch member without the spring receiving element is fitted in the opposite second guide groove. Thus, it is possible to position the spring receiving element in the bobbin case.

In a full rotary hook of the prior art where guide grooves are formed to be parallel, the widths of a pair of guiding portions forming the corresponding guide grooves are uniform in the radial direction of the bobbin case. Therefore, in order to move the latch member which has the bent tail portion formed thereon in the radial direction of the bobbin case and fit it in the guide grooves, the outer flange of the bobbin case must be bent partially so that it does not interfere with the tail portion. In the invention, the outer flange is not deformed at all and therefore it is made possible to reliably control the slackness of the needle thread loop to a small amount by means of the outer flange. Moreover, it is possible to smoothly assemble the latch member in the bobbin case.

According to the invention, as described above it is possible not only to increase the quantity of bobbin thread wound on the bobbin by increasing the inner diameter of the bobbin case, but also to move the latch member which has a bent tail portion in the radial direction of the bobbin case to install the latch member smoothly in the guide grooves formed in the bobbin case.

Furthermore according to the invention, the spring receiving element which projects outwardly on one side of the latch member can be moved while being fitted in one of the guide grooves, and therefore the latch member can be moved stably along the guide grooves.

According to the invention, the cylindrical portion of the bobbin case holder and the cylindrical portion of the bobbin case are overlapped in the axial direction along a portion of the circumferences thereof, and consequently the outer diameter of the bobbin flange which is housed in the bobbin case can be increased near to the inner periphery of the bobbin case holder cylindrical portion. Thereby it is possible to increase the quantity of bobbin thread wound around the bobbin.

According to the invention, the end of the cylindrical portion of the bobbin case holder and the end of the cylindrical portion of the bobbin case oppose each other near the rotation restraining notch of the bobbin case holder, and the end of the cylindrical portion of the bobbin case holder is located radially outwardly of the end of the cylindrical portion of the bobbin case. Therefore, when looped needle thread moves the needle thread loop is first hooked on the end of the cylindrical portion of the bobbin case holder and then passes between the rotation restraining notch and the rotation restraining member which is fitted therein. Consequently the needle thread loop can smoothly pass between the rotation restraining notch and the rotation restraining member, and therefore undesirably strong tension does not act on the needle thread. This improves sewing performance.

According to the invention as described above, it is possible to increase the quantity of bobbin thread wound on the bobbin and to cause the needle thread loop to pass smoothly between the rotation restraining notch of the bobbin case holder and the rotation restraining member fitted in such notch.

BRIEF DESCRIPTION OF THE DRAWINGS

Other and further objects, features, and advantages of the invention will be apparent from the following detailed description, taken with reference to the accompanying drawings, wherein:

FIGS. 9(1) and 9(2) are plan views showing an assembled condition of the bobbin case;

FIGS. 12(1)–12(4) are sectional views showing a sequence of assembly of the latch member;

DETAILED DESCRIPTION OF THE PREFERRED EMBODIMENTS

With reference to the drawings, preferred embodiments of the invention now will be described.

Figure 1:
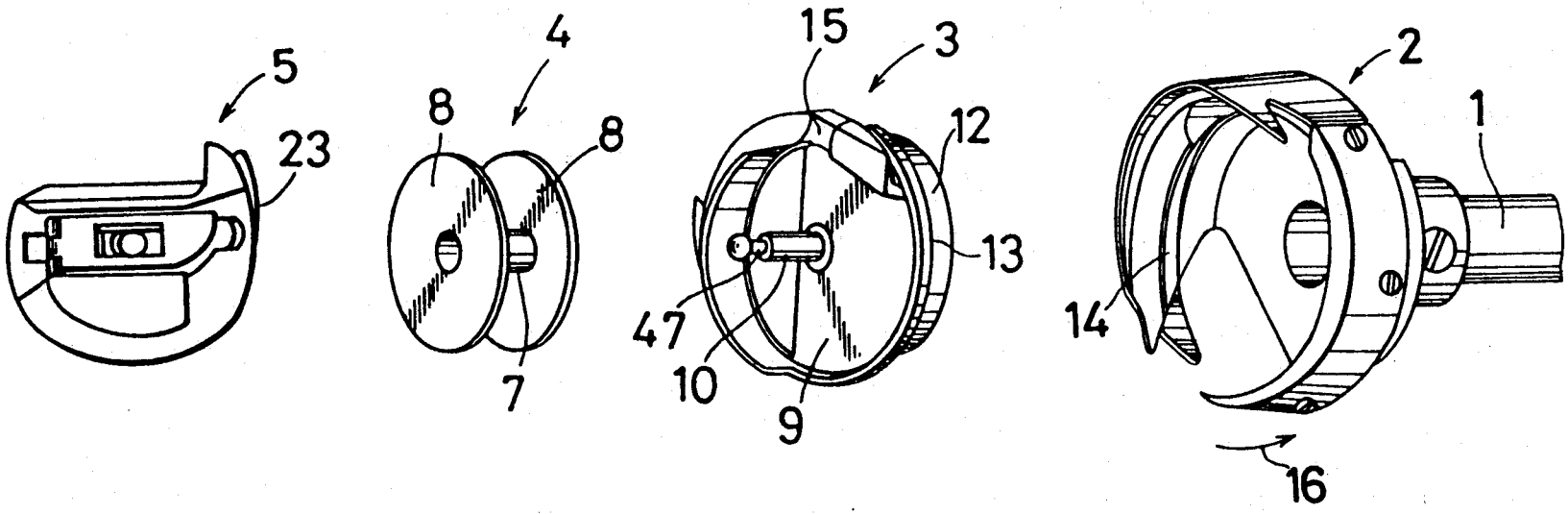
FIG. 1 is a fragmentary perspective view of an embodiment of the invention.

FIG. 1 is a fragmentary perspective view of an embodiment of the invention. Fixed on a shaft 1 which is driven to rotate is a hook body 2 wherein a bobbin case holder 3 is housed. A bobbin case 5 which houses a bobbin 4 is housed in the bobbin case holder 3.

Figure 2:
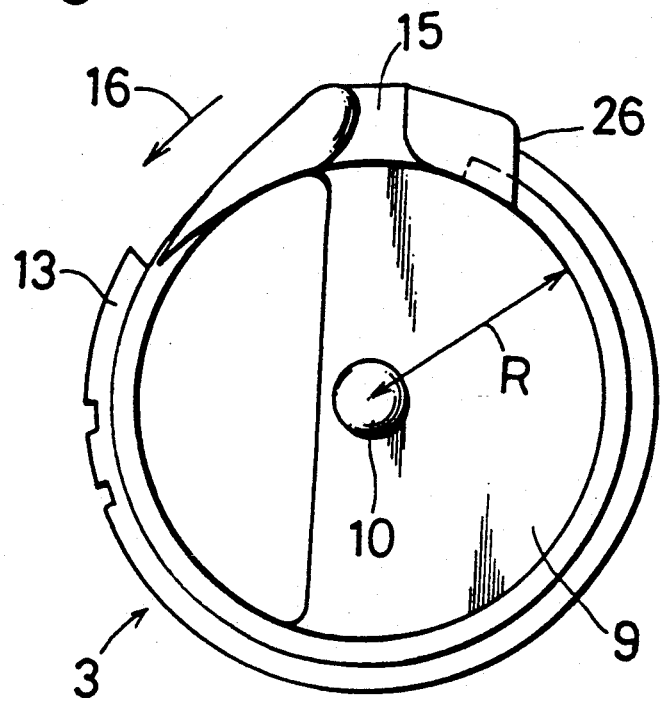
FIG. 2 is a front view of a bobbin case holder.
Figure 3:
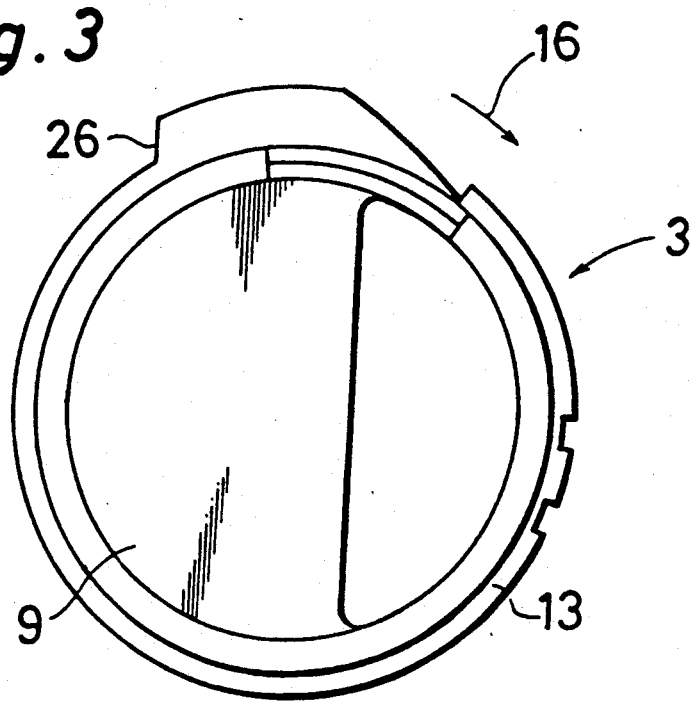
FIG. 3 is a rear view of a bobbin case holder.
Figure 4:
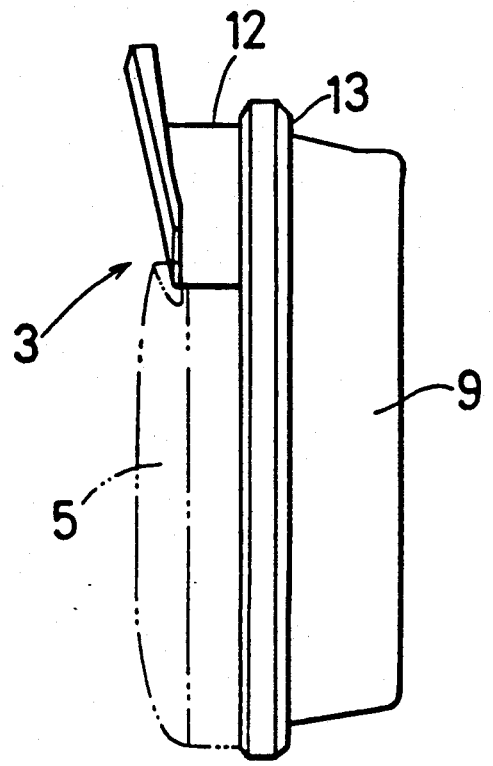
FIG. 4 is a side view of a bobbin case holder.
Figure 5:
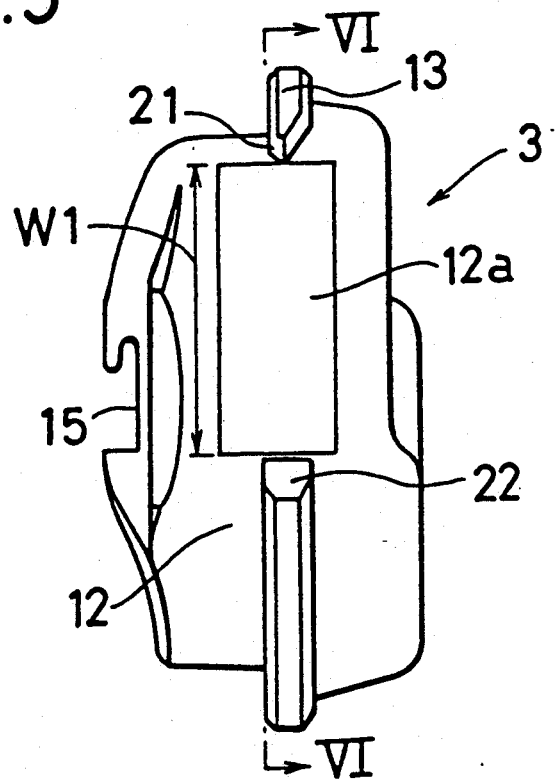
FIG. 5 is a plan view of a bobbin case holder.
Figure 6:
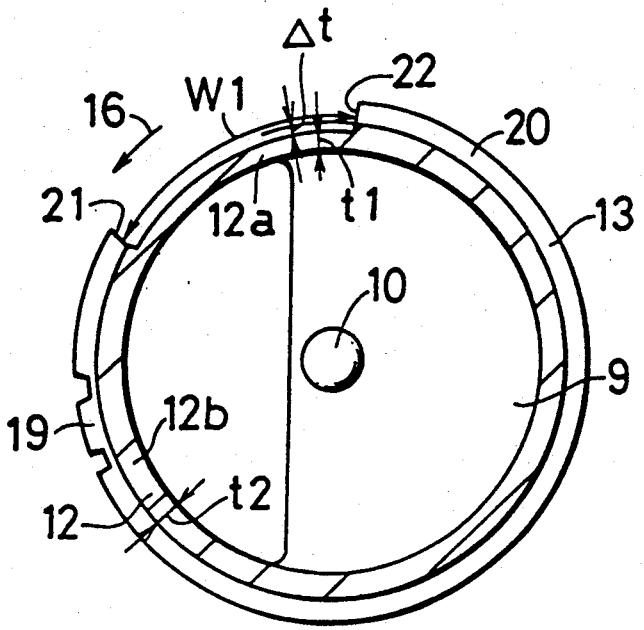
FIG. 6 is a sectional view of the bobbin case holder along line VI—VI in FIG. 5.
Figure 7:
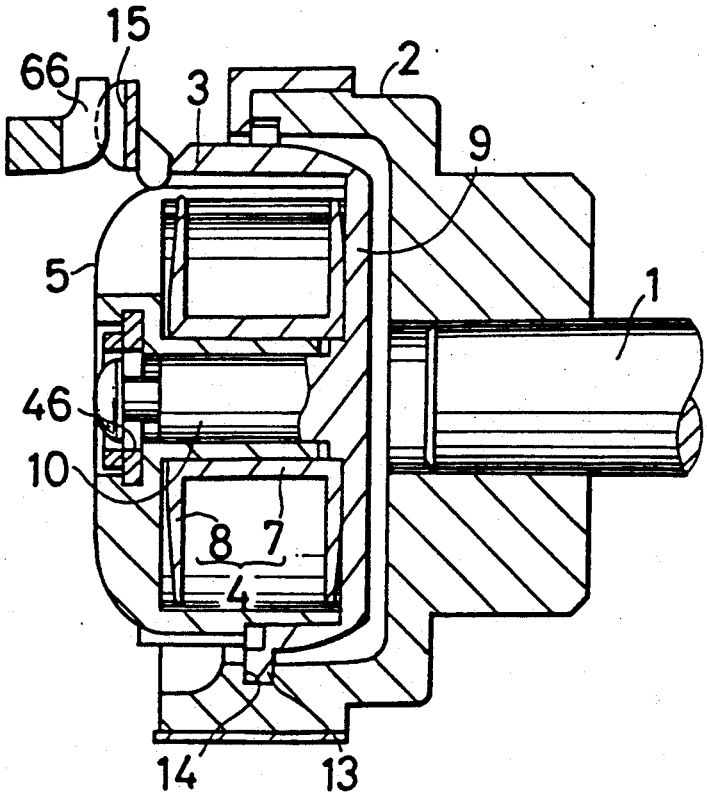
FIG. 7 is a vertical longitudinal sectional view of a full rotary hook.

FIG. 2 is a front view of the bobbin case holder 3, FIG. 3 is a rear view of the bobbin case holder 3, FIG. 4 is a side view of the bobbin case holder 3, FIG. 5 is a plan view of the bobbin case holder and FIG. 6 is a sectional view along line VI—VI. A longitudinal and horizontal cross section of a full rotary hook including bobbin case holder 3 is shown in FIG. 7. The bobbin 4 includes a winding drum 7 of a straight cylinder shape whereon bobbin thread is wound, and flanges 8 which are fixed to opposite axial ends of the winding drum 7. Extending perpendicularly from a bottom 9 of the bobbin case holder 3 is a stud 10 which passes through the winding drum 7 of the bobbin 4. On the outer periphery of a cylindrical portion 12 of the bobbin case holder 3 is formed a bobbin case holder rib 13 which fits in a hook groove 14 formed in the hook body 2. Fitted in a rotation restraining notch 15 of the bobbin case holder 3 is a rotation restraining member 66 which is fixed to the body of the sewing machine. Thus, when the hook body 2 rotates in the direction shown by an arrow 16, the bobbin case holder 3 is prevented from rotating.

The bobbin case holder rib 13 has formed thereon a thread hook portion 21 for hooking a needle thread loop and a thread releasing portion 22. In order to increase the quantity of bobbin thread wound on bobbin 4, the outer diameter of the flanges 8 is increased. Accordingly, the diameter of a cylindrical portion 23 of the bobbin case 5 may be increased and the wall thickness of the cylindrical portion 12 of the bobbin case holder 3 must be decreased. When the inner diameter of the cylindrical portion 12 of bobbin case holder 3 is increased and overall wall thickness thereof is decreased, the strength of the cylindrical portion 12 is lowered.

According to the invention, a thickness t1 of a part 12*a* of cylindrical potion 12 extending circumferentially from the thread hook portion 21 to the thread releasing portion 22 is less than a thickness t2 of a remainder 12*b* of cylindrical portion 12. Inner diameters of the portions 12*a*, 12*b* are equal and uniform, and the difference between the thickness t1 of the portion 12*a* and the thickness t2 of the portion 12*b* is $\Delta t$. The needle thread is present in a zone W1 corresponding to portion 12*a* and having reduced thickness t1. Thus, the needle thread does not receive undesirably large friction forces in the space between the outer periphery of the portion 12*a* and the inner periphery of the hook body 2. The remainder portion 12*b* has thickness t2 which is sufficient to maintain the necessary strength of the cylindrical portion 12. For example, inner diameter 2R of the cylindrical portion 12 of the bobbin case holder 3 may be greater than the inner diameter of the conventional bobbin case holder by 0.66 mm, the outer diameter of the portion 12*a* may be equal to the outer diameter of the cylindrical portion of the conventional bobbin case holder, and outer diameter of the remainder portion 12*b* may be greater than the outer diameter of the cylindrical portion of the conventional bobbin case holder by 0.6 mm.

Figure 8:
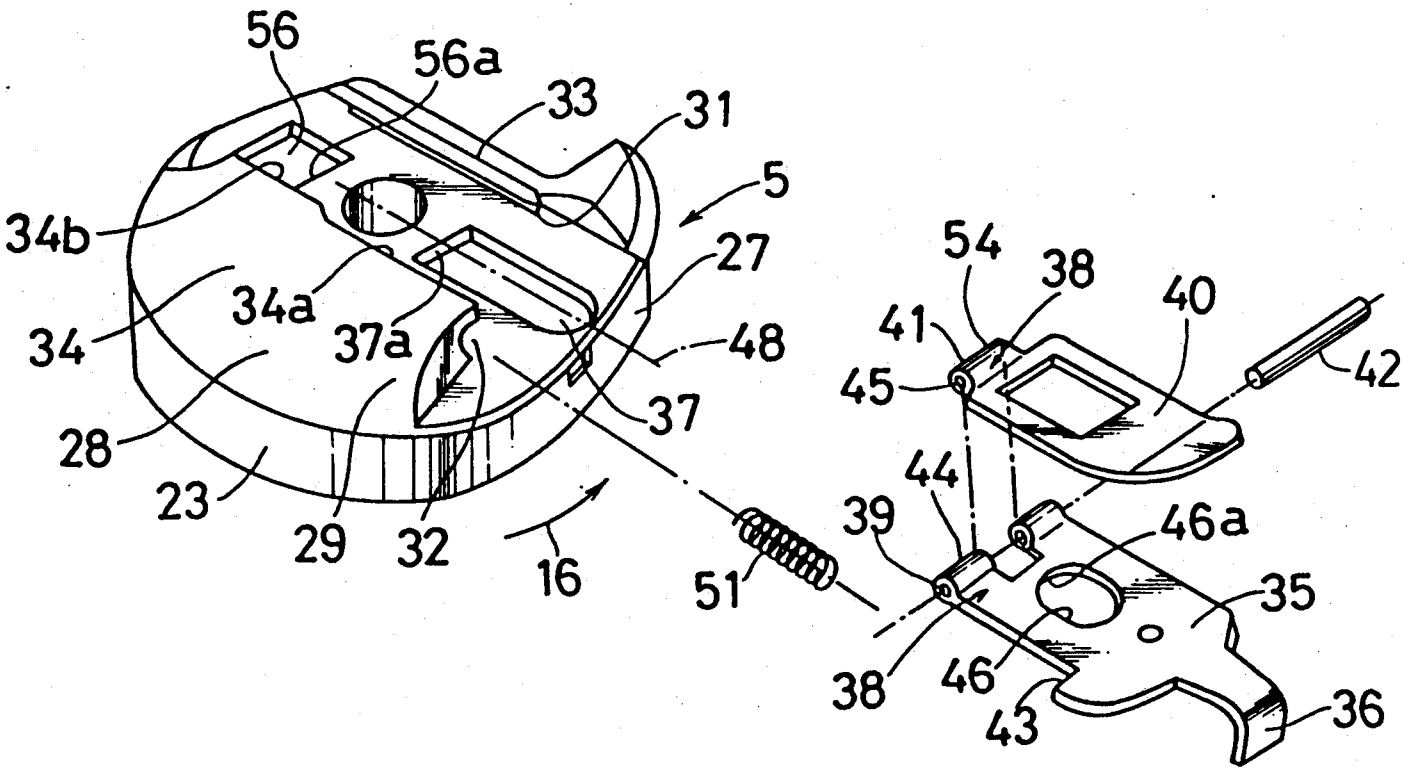
FIG. 8 is a fragmentary perspective view of a bobbin case.

FIG. 8 is a fragmentary perspective view of the bobbin case 5 of the invention, and FIGS. 9(1) and 9(2) are front views showing conditions of assembly of the bobbin case 5. The cylindrical portion 12 of the bobbin case holder 3 and the cylindrical portion 23 of the bobbin case 5 axially overlap along a portion of the circumferential dimensions thereof. An upstream end 26, relative to the direction 16 of rotation of hook body 2, of the cylindrical portion 12 of the bobbin case holder 3 and a downstream end 27, relative to direction 16, of the cylindrical portion 23 of the bobbin case 5 are oppositely disposed near the rotation restraining notch 15 of the bobbin case holder 3. An outward flange 29 is formed in body 28 of bobbin case 5 to guide the needle thread loop and to control the slack of the needle thread to a small amount.

In an end face of the body 28 of the bobbin case 5 at the side of the open end of the bobbin case holder 3 are formed a pair of opposing guide grooves 31, 32 defined by guide portions 33, 34. The guide grooves 31, 32 extend parallel to the radial direction of the bobbin case 5, and opposite sides of a latch member 35 are fitted in and freely movable along the guide grooves 31, 32. Formed at an end of the latch member 35 is a bent tail portion 36 which passes through a hole 37 formed in the body 28 of the bobbin case 5 and enters the bobbin case 5 in the axial direction of the body 28. The hole 37 extends in the radial direction of the bobbin case 5. The tail portion 36 contacts the outer periphery of the flange 8 of bobbin 4 that is disposed at the open end side of the bobbin case holder 3. Such contact enables the bobbin case 5 and the bobbin 4 to be removed together from bobbin case holder 3 when bobbin 4 is locked in bobbin case 5.

In an end of the latch member 35 opposite the tail portion 36 is formed a through hole 39, e.g. by bending a part of the latch member 35, thus forming supports 44 of a hinge 38. On an end of an operating member 40 is formed a through hole 45, e.g. by bending the material of member 40, thus forming a support 41 of hinge 38. A hinge pin 42 passes through one hole 39 of the latch member 35, through the hole 45 of the member 40 and through the other hole 39 of member 35. Thereby, the latch member 35 and the operating member 40 are connected for relative angular displacement around the axis of the hinge pin 42. Formed on a side of the latch member 35 is a spring receiving element 43 which projects outwardly. The latch member 35 also has formed therein a latch hole 46 extending in the longitudinal direction thereof. An end 46*a* of the latch hole 46 can be engaged with a small diameter portion 47 formed at an end of the stud 10 and thereby latched. Such latched condition is released by movement of the latch member 35.

The guide groove 31 formed by the guide portion 33 is parallel to a diameter 48 of the bobbin case 5. The guide portion 34 has a part 34*a* which is near the hole 37 and a part 34*b* which is spaced from the hole 37, and accordingly the guide groove 32 has a portion 32*a* which is near the hole 37 and a portion 32*b* which is spaced from the hole 37. The guide groove portions 32*a*, 32*b* have a step 50 formed therebetween.

Figure 10:
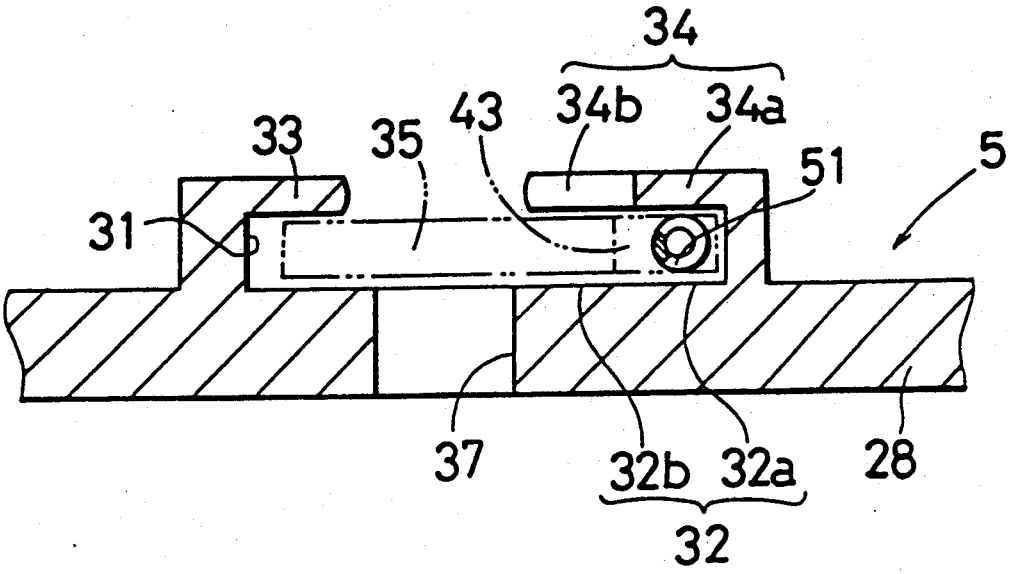
FIG. 10 is a sectional view of the bobbin case along line X—X in FIG. 9(1)

FIG. 10 is a sectional view along line X—X of FIG. 9(1). Installed in the guide groove portion 32*a* is a coil spring 51 one end of which is in contact with the step 50 and other end of which is in contact with the spring receiving element 43. Thus, the spring 51 forces the latch member 35 in the direction of arrow 52 in FIGS. 9(1) and 9(2), namely outwardly in the radial direction of the body 28 of the bobbin case 5. The part 34*a* of the guide portion 34 near hole 37 is recessed in a direction away from guide groove 31.

Figure 11:
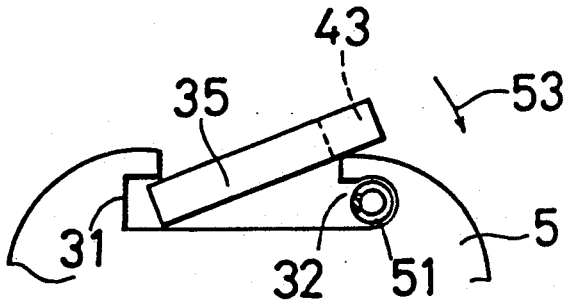
FIG. 11 is a partial view illustrating the fitting of a latch member in guide grooves.

In mounting the latch member 35 on the body 28 of the bobbin case 5, one side of the latch member 35 is inserted in the guide groove 31 as shown in FIG. 11, and the latch member 35 is caused to make an angular displacement in the direction of the arrow 53 such that the tail portion 36 is located in the hole 37, whereby the latch member 35 is in the position shown in FIG. 9(1) and FIG. 10. In this condition, the side of the latch member 35 which includes the spring receiving element 43 is exposed from the guide groove 32.

The operating member 40 has a cam 54 formed at an end thereof. The cam 54 pulls the latch member 35 in the direction of an arrow 55 against the force of the spring 51 as shown in FIG. 12(1), when the operation member 40 is angularly displaced in the direction of an arrow 57*a*, and the tail portion 36 abuts a flange 8 of bobbin 4. By locating the bobbin case 5 which houses the bobbin 4 in the bobbin case holder 3 such that the cam 54 extends into an operating hole 56 formed in the body 28 of the bobbin case 5 as shown in FIG. 12(2), end edge 46*a* of the latch member 35 passes over a spherical end 80 of the stud 10. Accordingly, the latch member 35 is displaced in the direction of an arrow 55*a* (FIG. 12(2)) by spring 1 and fits into the small diameter portion 47 of the stud 10. Thus, the bobbin case 5 which houses the bobbin 4 is latched in the bobbin case holder 3, and unintentional release therefrom is prevented. When the operating member 40 makes an angular displacement in the direction of an arrow 57, the spring 51 urges the operating member 40 to make an angular displacement in the direction of the arrow 57. Therefore, in the condition shown in FIG. 12(1), as shown in FIG. 9(2), the spring receiving element 43 is in the guide groove portion 32*a*, the corresponding side of the latch member 35 is in the guide groove portion 32*b*, and the other side of the latch member 35 is in the guide groove 31. Accordingly, the latch member 35 can stably move along the guide grooves 31, 32. When the operating member 40 is released it is caused to make an angular displacement in the direction of the arrow 57 by the spring force of the spring 51 and makes an angular displacement from the position shown in FIG. 12(3) to the position shown in FIG. 12(4), with the end 46*a* of the latch hole 46 of the latch member 35 within the small diameter latching portion 47 of the stud 10, thereby achieving a latched state.

When the operating member 40 is raised in the direction 57*a* reverse to the arrow 57, the cam 54 comes into contact with the end 56*a* of the operating hole 56 and the latch member 35 displaces in the direction of an arrow 59, FIG. 12(3). Thereby the tail portion 36 presses the flange 8 of the bobbin 4 inwardly in the radial direction and holds it, while the end portion 46*a* of the latch hole 46 departs from the small diameter portion 47 of stud 10. Therefore, the bobbin case 5 and the bobbin 4 can be removed from the bobbin case holder 3 together by pulling the bobbin case 5 in the direction of an arrow 60 shown in FIG. 12(3).

The latch member 35 has a stopper 62 formed thereon. Displacement of the latch member 35 in the direction of arrow 59 is restricted by the stopper 62 coming into contact with an end 37*a* of the hole 37.

Figure 13:
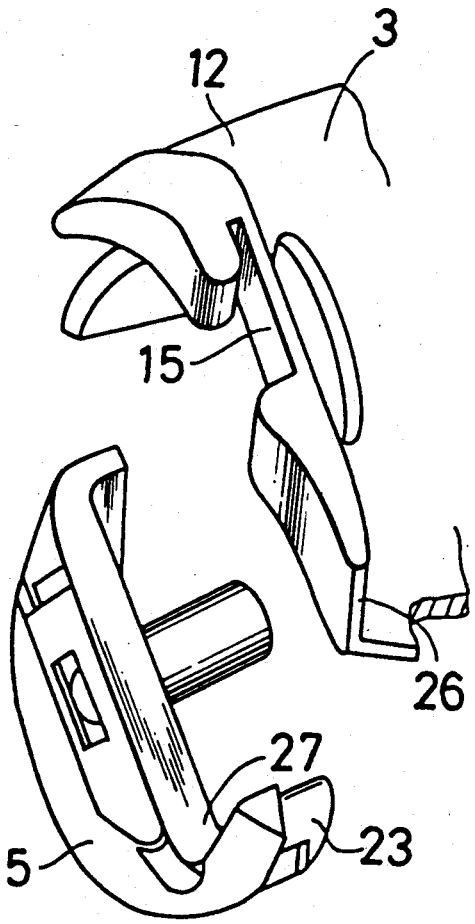
FIG. 13 is a fragmentary perspective view of an end of a cylindrical portion of the bobbin case holder and an end of a cylindrical portion of the bobbin case.
Figure 14:
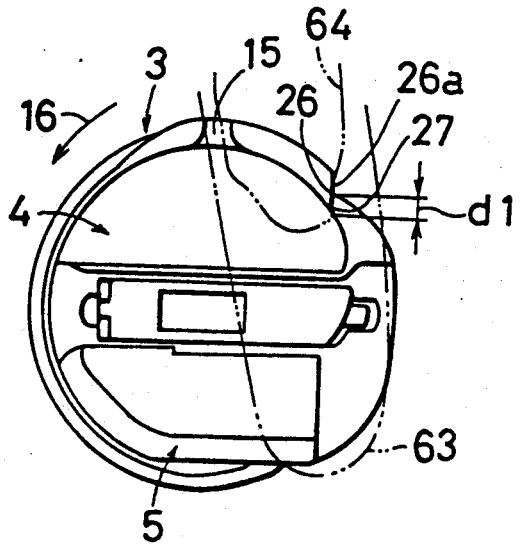
FIG. 14 is a plan view showing the bobbin case mounted in the bobbin case holder.

FIG. 13 is a perspective view of a part of the bobbin case holder 3 and the bobbin case 5. FIG. 14 is a front view of the bobbin case holder 3 housing the bobbin case 5. Near the rotation restraining notch 15 of the bobbin case holder 3, end 26 of the cylindrical portion 12 of bobbin case holder 3 and end 27 of the cylindrical portion 23 of bobbin case 5 oppose each other as described above. As clearly shown in FIG. 14, the end 26 is located further outwardly in the radial direction than the end 27, that is, a step d1 is formed between the end 26 and the end 27.

Figure 15:
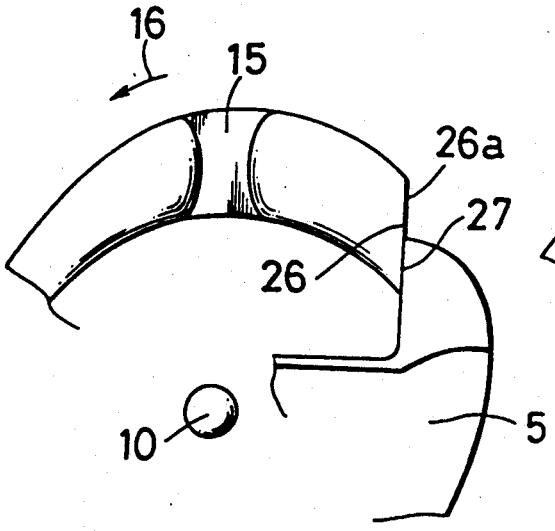
FIG. 15 is a plan view of a portion adjacent the ends of the cylindrical portions.

FIG. 15 is an enlarged front view of the vicinity of the ends 26 and 27. When the hook body rotates in the direction 16, a needle thread loop is in the position indicated by 63 in FIG. 14, where the needle thread loop is guided by the flange 29 and controlled so that slackness of the needle thread loop is decreased. When the needle thread loop 63 is lifted by the upward motion of a thread take-up lever (not shown) to the position indicated by 64, the needle thread passes over the outer periphery of the flange 29, and comes into contact with a part 26*a* of the end 26. When the needle thread 64 is further pulled by the thread take-up lever, the needle thread passes between the rotation restraining notch 15 of the bobbin case holder 3 and the rotation restraining member 66. In this manner, when the hook body 2 is rotating at a low speed, in particular, the needle thread loop is hooked on the part 26*a* of the end 26 and then the needle thread 64 passes between the rotation restraining notch 15 and the rotation restraining member 66. Therefore, the motion of passing through is made smoothly without the needle thread touching other parts or being caught, and with the needle thread tension being stabilized. Sewing performance thus can be improved. The ends 26, 27 are parallel to the direction of diameter 48 (FIG. 8) of the bobbin case holder 3.

Figure 16:
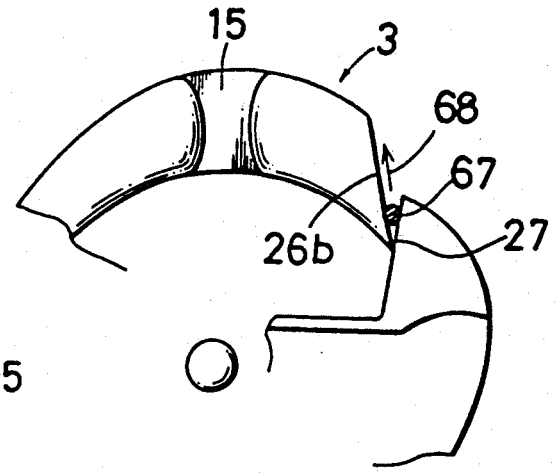
FIG. 16 is a similar plan view according to another embodiment of the invention.

In another embodiment of the invention, the end 26*a* formed on the bobbin case holder 3 may be inclined toward the rotation restraining notch 15 and radially outwardly, as shown in FIG. 16. This causes needle thread 67 to be pulled smoothly along the end 26*a*, as indicated by arrow 68, while the needle thread smoothly passes between the rotation restraining notch 15 and the rotation restraining member 66.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. In a full rotary hook including a bobbin case holder to be mounted in a rotatable hook body and a bobbin case to receive a bobbin removably mounted in said bobbin case holder such that said bobbin case and the bobbin together are mountable on and removable from said bobbin case holder, the improvement comprising a construction of said bobbin case holder and said bobbin case to enable an increase size bobbin having wound thereon an increased amount of thread to be employed without increasing a given size of the hook body and without substantially decreasing the strength of said bobbin case holder, said construction comprising:

said bobbin case having a cylindrical portion of an increased outer diameter and an increased inner diameter when compared to a given bobbin case; and said bobbin case holder having a cylindrical portion having on the outer periphery thereof a thread hooking portion and a thread releasing portion, said cylindrical portion of said bobbin case holder having a uniform increased inner diameter to accommodate said increased outer diameter of said cylindrical portion of said bobbin case, said cylindrical portion of said bobbin case holder having a stepped outer periphery including a first circumferential portion extending from said thread releasing portion to said thread hooking portion relative to a direction of rotation of the hook body and a second remainder circumferential portion, said first circumferential portion having a reduced radial thickness, and said second remainder circumferential portion having an increased outer diameter greater than an outer diameter of said first circumferential portion and a radial thickness greater than said radial thickness of said first circumferential portion.

2. The improvement claimed in claim 1, further comprising means to latch said bobbin case and the bobbin in said bobbin case holder, said latch means comprising a stud extending coaxially from said bobbin case holder and means on said bobbin case for holding said bobbin to said bobbin case and for holding said bobbin case to said stud, said holding means comprising a pair of parallel opposed guide grooves formed in an end of said bobbin case, a first said guide groove having a portion recessed in a direction away from a second said guide groove, said that said first guide groove has two length portion longitudinally divided by a step, a latch member having first and second opposite edges slidably received in said first and second guide grooves, respectively, said first edge having extending outwardly therefrom a spring receiving element slidable within said recessed portion of said first guide groove, a spring positioned within said first guide groove and having opposite ends abutting said step and said spring receiving element, thereby urging said latch member to slide in said guide grooves in a direction causing a surface of said latch member to catch on said stud, and said latch member having at a longitudinal first end thereof a bent portion to abut the bobbin.

3. The improvement claimed in claim 2, further comprising an operating member pivoted to a second end of said latch member and having a cam abuttable against said bobbin case to thereby move said latch member relative to said bobbin case against the force of said spring to release said latch member from said stud.

4. The improvement claimed in claim 1, wherein said cylindrical portion of said bobbin case defined an end member, and said cylindrical portion of said bobbin case holder defines an end that circumferentially confronts and that extends radially outwardly beyond said end of said cylindrical portion of said bobbin case.

* * * * *